US008007416B2

(12) United States Patent
Arlie

(10) Patent No.: US 8,007,416 B2
(45) Date of Patent: Aug. 30, 2011

(54) FLAT DUMBBELLS THAT MAY BE CLUSTERED IN VARIOUS COMBINATIONS AND HELD TOGETHER BY THE USER'S GRIP

(76) Inventor: Daniel Arlie, Palo Alto, CA (US)

( * ) Notice: Subject to any disclaimer, the term of this patent is extended or adjusted under 35 U.S.C. 154(b) by 0 days.

(21) Appl. No.: 12/896,909

(22) Filed: Oct. 3, 2010

(65) Prior Publication Data

US 2011/0082017 A1 Apr. 7, 2011

(51) Int. Cl.
*A63B 21/072* (2006.01)
*A63B 21/075* (2006.01)

(52) U.S. Cl. ..... 482/108; 482/106; 482/93

(58) Field of Classification Search ..... 482/44, 482/49, 50, 92, 93, 106, 108; *A63B 21/072, A63B 21/075*

See application file for complete search history.

(56) References Cited

U.S. PATENT DOCUMENTS

| | | | | |
|---|---|---|---|---|
| 5,131,898 | A * | 7/1992 | Panagos | 482/108 |
| 5,171,199 | A * | 12/1992 | Panagos | 482/106 |
| 5,291,631 | A * | 3/1994 | Schjoneman | 16/86 R |
| 5,692,996 | A * | 12/1997 | Widerman | 482/93 |
| 5,741,206 | A * | 4/1998 | Anastasi | 482/105 |
| 6,224,517 | B1 * | 5/2001 | Dereszynski | 482/93 |
| 6,261,022 | B1 * | 7/2001 | Dalebout et al. | 482/107 |
| 6,387,022 | B1 * | 5/2002 | Smith | 482/106 |
| 6,461,282 | B1 * | 10/2002 | Fenelon | 482/106 |
| 6,730,004 | B2 * | 5/2004 | Selsam | 482/93 |
| 7,011,611 | B1 * | 3/2006 | Ripley | 482/107 |
| 7,014,598 | B2 * | 3/2006 | Fenelon et al. | 482/107 |
| 7,494,452 | B2 * | 2/2009 | Kemery et al. | 482/108 |
| 7,578,772 | B2 * | 8/2009 | Lippitt | 482/108 |
| 7,588,520 | B2 * | 9/2009 | Nalley | 482/107 |
| 7,762,933 | B1 * | 7/2010 | Yu | 482/107 |
| 7,811,212 | B2 * | 10/2010 | Chen | 482/107 |
| 2005/0065003 | A1 * | 3/2005 | Klotzki | 482/107 |
| 2009/0156375 | A1 * | 6/2009 | Chiang | 482/108 |
| 2009/0203506 | A1 * | 8/2009 | Kessler et al. | 482/108 |
| 2010/0022365 | A1 * | 1/2010 | Ngu | 482/108 |
| 2010/0087297 | A1 * | 4/2010 | Kanaoka | 482/108 |
| 2010/0178981 | A1 * | 7/2010 | Holcomb et al. | 463/37 |

* cited by examiner

*Primary Examiner* — Loan Thanh
*Assistant Examiner* — Sundhara Ganesan

(57) ABSTRACT

A rigid adjustable hand weight system for use in physical fitness exercise consisting of a rigid flat handle portion with rigid flat weight members disposed on either end whose size and shape are such that two or more units may be bundled together and held within the user's hand secured together by the user's grip. Each unit may be held singularly or in a group with one or more other units in various combinations to create a hand weight bundle of the desired poundage. For instance, units weighing 2, 3 and 4 pounds may be lifted singularly or combined as necessary to create 5, 6, 7 and 9 pound weight combinations as the user desires. Eliminated is the need for fasteners such as screws, pins or other means since the user's grip provides the force that keeps the units bundled together. This allows for quicker changing of the weight being lifted as the user can simply pick up or put down the number of units required to achieve the desired lift weight rather than adding or removing weight plates to or from a single connecting device and securing them by mechanical means.

1 Claim, 5 Drawing Sheets

FLAT DUMBBELLS THAT MAY BE CLUSTERED IN VARIOUS COMBINATIONS AND HELD TOGETHER BY THE USER'S GRIP

FIELD OF THE INVENTION

The present invention relates generally to the field of exercise and weight training equipment, and specifically to rigid adjustable hand weights.

BACKGROUND OF THE INVENTION

Prior Art

Free weight training for physical fitness requires that specific weights be used for specific exercises and that those weights be changed throughout the exercise session to match the exercise being preformed. This requires the user to have an array of dumbbells of varying poundage or a pair of adjustable units whose weight can be changed by adding or removing weight plates.

A set of multiple non-adjustable units of different sizes requires a great deal of space for their storage and can weight several hundred pounds rendering them essentially unportable. Single units with the ability to have their weight adjusted take a measure of time to change from one weight to another due to the need for them to be secured by some retaining mechanism such as a clamp, pin or screw on collar. Some units that utilize dials or other mechanisms to choose the weight can be complicated, unwieldy and expensive as well as fragile and prone to breakage if dropped.

Another approach has been to create a bifurcated dumbbell that allows each half be lifted separately or the two halves to be gripped together and lifted as one unit. However, this allows only 1 weight combination as the shape of the unit is simply a dumbbell cut in half and more than two units cannot be gripped at the same time.

U.S. Pat. No. 6,224,517, Dereszynski, describes a flattened non-rigid dumbbell shaped weight bag that while having an inherent similar shape, is not designed, nor proposed to be used with multiple units being brought together in the user's hand. To do so, the non-rigid form would require 2 dumbbell shaped weight bags to be held at identical angles when they are brought together or else they would flop around and bump into each other. This would not allow the immediate and easy changing of weight combinations and indeed, the inventor has not suggested they be used in that manner. Also, the flexible material would not slide easily against another unit made of the same material making lining up of multiple units difficult. Indeed, the flexibility of the material is used to conform to body parts so it will stay in place. Trying to perfectly line up 3 or more of these in the users hand would take a great deal of time where the present invention allows the user to immediately line up the units through the simple act of holding them together due to the fact that they easily slide into alignment immediately upon being gripped. The main purpose of the present invention is a dumbbell whose weight can be changed at any angle throughout any exercise in a split second without stopping that exercise routine to line up or adjust the weights. This would not be possible with the non-rigid dumbbell shaped beanbag shown in the prior art example.

U.S. Pat. Nos. #5,131,898 and #5,171,199, Panagos, describes a system of interlocking dumbbells that requires the user to use both hands to hold two units together compared to the present invention which only uses only one hand to hold three or more units together. The prior art described are simply normally shaped dumbbells with alignment pins and resister holes to keep two units from sliding around when the user brings two of them together holding them with both hands.

US Patent 2009/0203506, Kessler, describes a similar dumbbell system which interlocks for the purpose of storage. It is not flattened to allow two or more units to be held in the hand at the same time however.

U.S. Pat. No. #5,692,996, Widerman, describes a large weight that is not a dumbbell shape and not designed to be held in multiples in the user's hand.

U.S. Pat. No. #5,741,206 describes a set of stackable weights that are held together by a strap wrapped around various parts of the user's body. The described invention would not be able to be easily held together within the user's hand as no handle is provided, the associated strap providing the means of holding the weights together.

U.S. Pat. No. #6,387,022, Smith, describes a medicine ball that may be adjusted by inserting multiple weight plates and securing them together by a screw in handle. This is a laborious process that would take 15 or 20 seconds to achieve compared to the half second it typically takes to change the desired lift weight on the present invention. Since it is a kettlebell, the user cannot do dumbbell exercises with it.

U.S. Pat. Nos. #6,461,282, 7,014,598, 7,011,611, 7,578,772, 7,588,520, 7,762,933, 7,811,212, an application 2005/0065003, describe various of single handled weight systems that allow additional weight units to be added and removed to the single handle. These all require the user to stop the exercise to add or remove the additional weight units to the single bar.

US Patent application #2009/0156375, Chiang, describes a dumbbell with detachable heads that may be re-oriented so the user can use them for pushup stands. This design does not allow the user to comfortably hold multiple units in one hand at the same time.

US Patent application #2010/0087297, Kanaoka, describes a dumbbell with off center of gravity weight portions. The flattened handle described allows the user to twist the off center weight units but would no allow the user to bring multiple units of 3 or more together since the off center weight portions would bump into each other as with any other standard dumbbell. In fact, with the off center weight portions shown, the ability to hold multiple units in one hand would be even less than with standard dumbbells.

US Patent application #2010/0178981 describes a weight that can be attached to a game controller. No more than one of these would fit in the hand at a time.

US Patent application #20100022365, Ngu, describes a similar dumbbell also designed to lay flat on the floor so the user can use as a support while doing pushups. The shape allows the unit to fit on the floor but does not allow multiple units to be held in the user's hand at the same time.

U.S. Pat. No. 6,730,004 shows a weight that is held in a single hand but that is adjusted by filling it with different amounts of water. This would take quite a bit of time compared to the split second it takes to change the weight by swapping plates as is done with the present described invention.

U.S. Pat. No. 7,494,452 describes a dumbbell with a unique shape that would not lend itself to holding more than one unit in the user's hand at a time.

U.S. Pat. No. 5,291,631 shows a flexible flat dumbbell shaped door stop designed to bend around a door's edge and loop over both doorknobs. It would not be usable as an exercise device.

Therefore, no other device has been shown that will solve these problems in the manner and by the method shown. Prior art attempting to solve the problems described show various means of securing weight members to a central handle structure via mechanical means such as pins, screw on collars or clamps, using a large number of single weights or having a single dumbbell that's split in two giving 1 possible weight combination.

The present described invention is the only one that allows the user to forgo any mechanical means to secure multiple rigid weight members together and instead allows them to simply hold the number of rigid weight members desired by bundling their handles together within the user's grip so that the multiple rigid weight members may be lifted together in various combinations.

There is a need in the art therefore for improved methods of changing the weight being lifted without adding complicated selector mechanisms, large sets of non-adjustable units or bifurcated dumbbells that only offer 2 weight choices per set.

OBJECTS AND ADVANTAGES

Accordingly, besides the above described objects and advantages of the present invention: Rigid Flat Dumbbells That May Be Clustered In Various Combinations And Held Together By the User's Grip, several objects and advantages are:

a) to provide a series of rigid flat dumbbells that can be held in groups of 3 or more within the user's hand.

b) to provide system of rigid hand-weights that may be interchanged instantaneously c) to provide a system of rigid hand-weights that can be gripped in various combinations and interchanged to provide more weight combinations than would be available with that number of units held singularly.

d) to provide an adjustable rigid hand-weight system that does not use pins, screws, bolts, collars or other mechanical means to secure the various weights together instead using the user's grip for this task.

SUMMARY OF THE INVENTION

In accordance with the present invention, a novel and useful adjustable rigid hand weight system that allows the user to hold various combinations of the weights they wish to lift within their hand's grip eliminating the need to physically attach them together by mechanical means is described. The present described invention allows more than two pieces of different weights to be brought together to form a single unit allowing up to 7 weight combinations for a 3 piece set. An example being a 2, 3 and 4 pound weight set which allows the user to hold the 2 and 3 pound weight together to form a 5 pound weight, the 4 and 3 pound weight to form a 7 pound weight, the 2, 3 and 4 pound weight to form a 9 pound weight et cetera.

DESCRIPTION OF THE PREFERRED EMBODIMENTS

The following embodiments of the present invention should be understood and interpreted in accordance with the heretofore described drawings.

Figure 1:
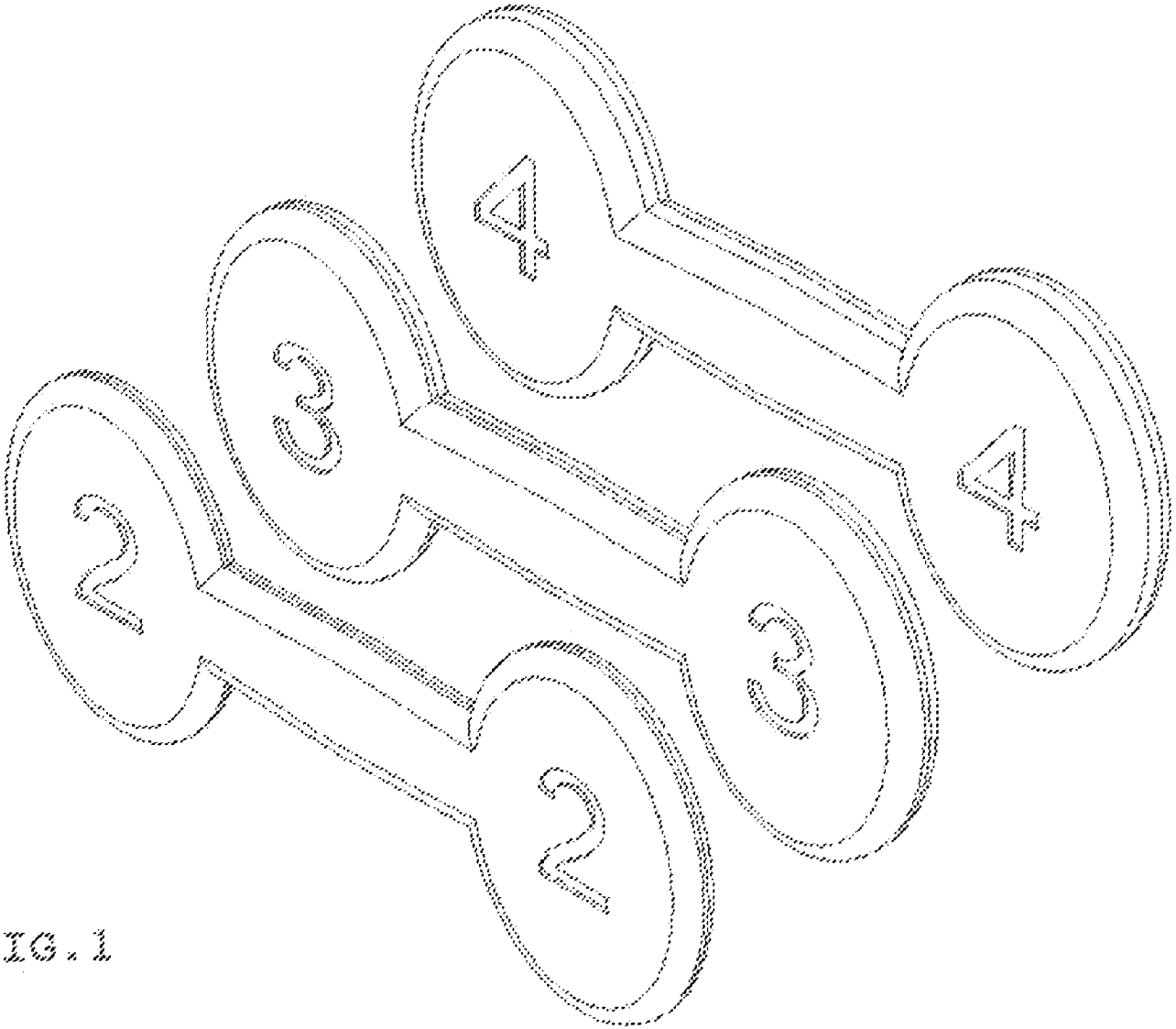
FIG. 1 is an isometric view of the preferred embodiment of the invention showing 3 units: a 2 pound a 3 pound and a 4 pound plate in an expanded view.
Figure 2:
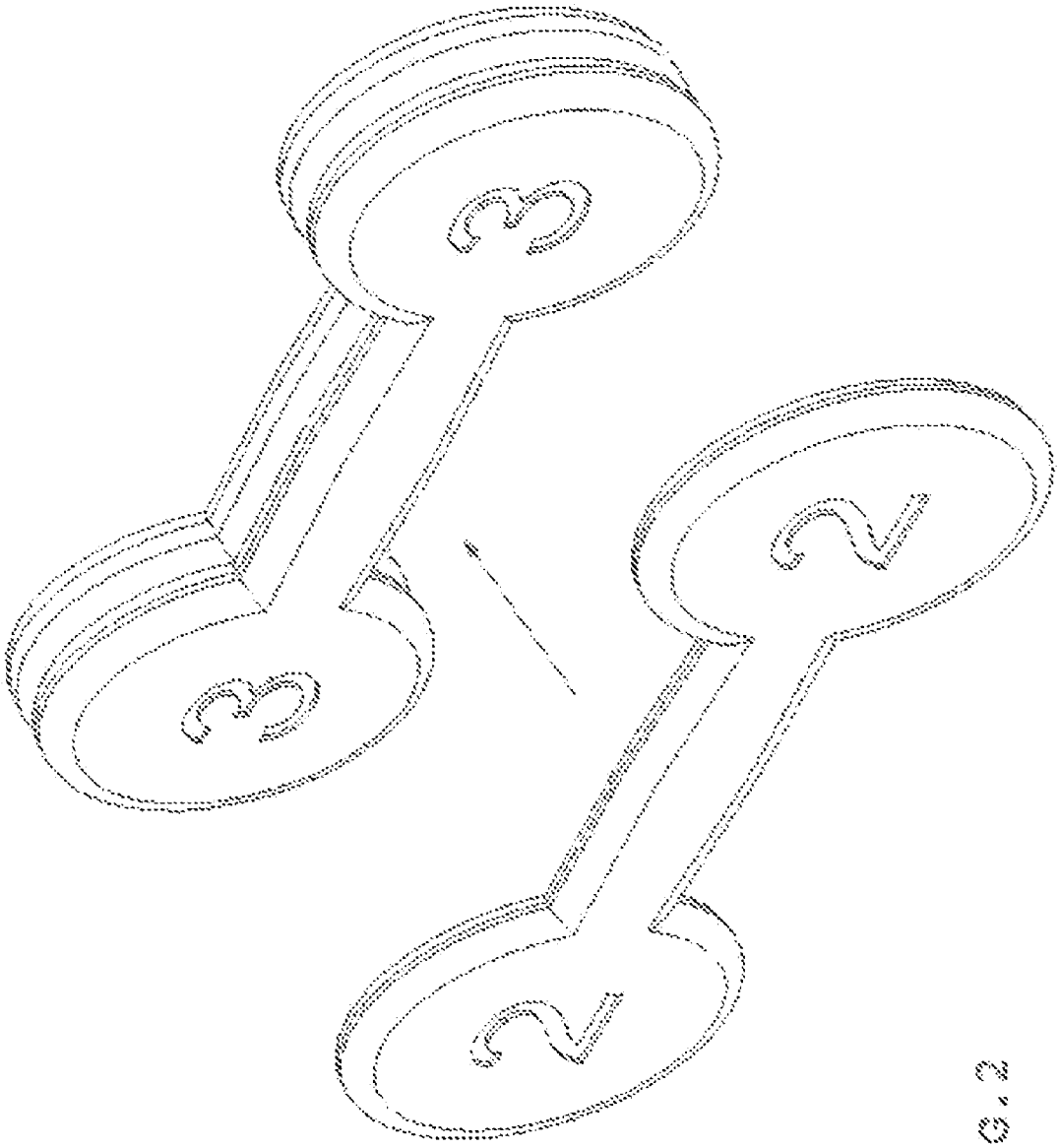
FIG. 2 is a view of the 3 plates being brought together into a bundle.
Figure 3:
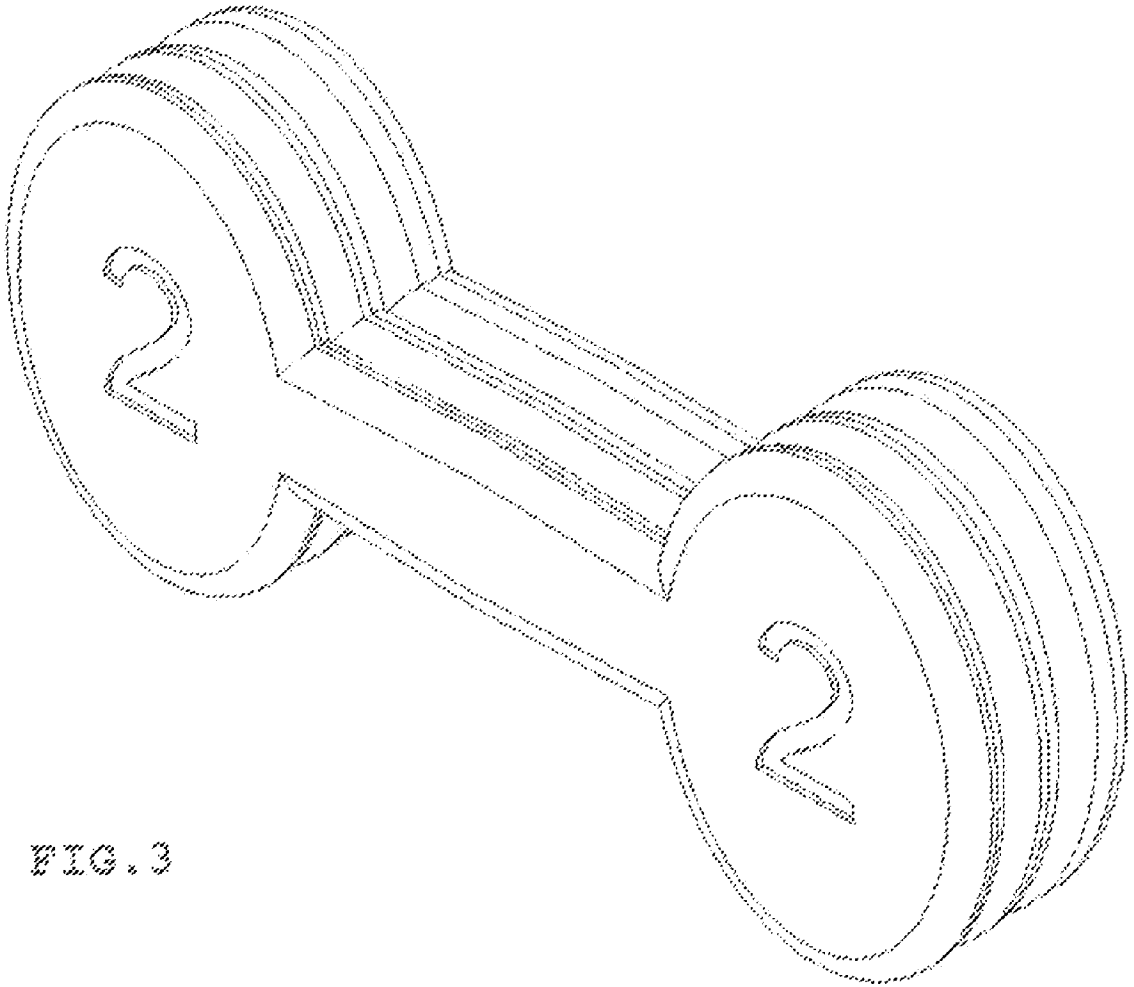
FIG. 3 is an isometric view of the 2, 3 and 4 pound plate stacked together and ready to be lifted as a 9 pound bundle.
Figure 4:
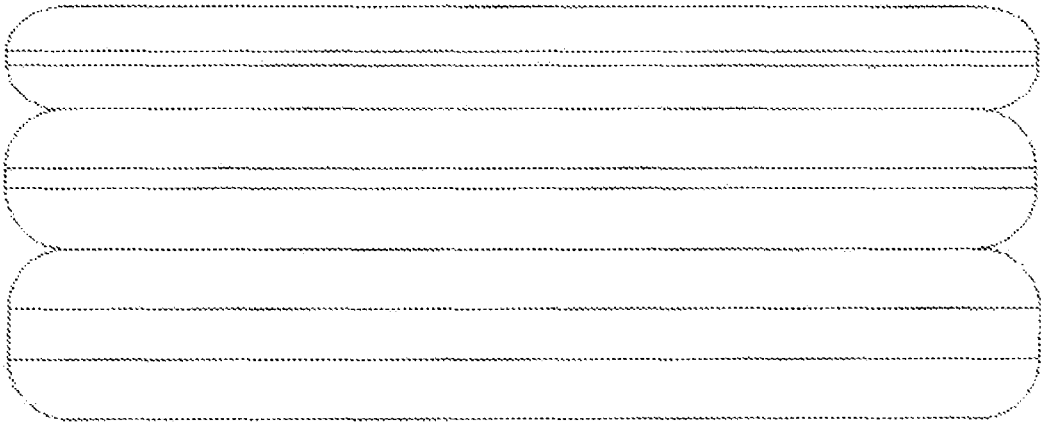
FIG. 4 is an end view of the 2, 3, and 4 pound plates combined into a 9 pound bundle.
Figure 5:
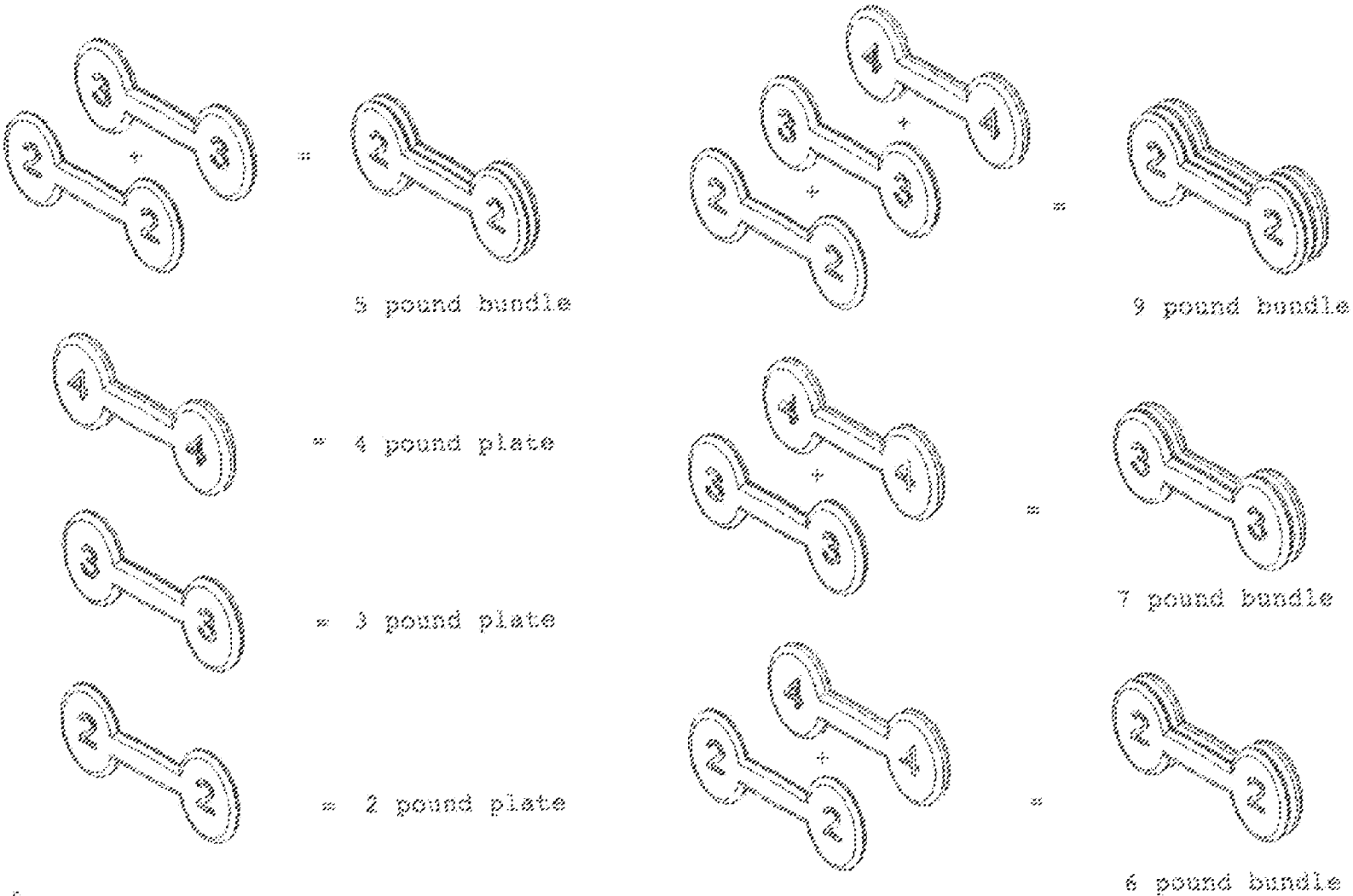
FIG. 5 is an illustration showing the 7 ways the preferred embodiment of the weights may be lifted individually as 2, 3 and 4 pound individual units or combined into 5, 6, 7 and 9 pound bundles.

The invention as a whole is depicted by reference FIG. 11*n* this preferred embodiment 3 plates are shown, a 2 pound a 3 pound and a 4 pound plate. Each of these can be lifted separately as individual dumbbells. FIG. 2 Illustrates those 3 plates being brought together so that they may all be held together within the user's hand. The 3 and 4 pound plates have already been bundled together and the 2 pound plate is being added. FIG. 3 This illustration shows the 2, 3 and 4 pound plate bundled together forming a 9 pound weight bundle as it would be held within the user's grip and lifted. FIG. 4 shows and end view of this 9 pound bundle. FIG. 5 shows a chart illustration how these 3 weights may be lifted singularly or combined to afford the user 7 different weight plates or bundled combinations.

Although the above description and drawings contain many specificities, these should not be construed as limiting the scope of the invention but as merely providing illustrations of some of the presently preferred embodiments of this invention.

Thus the scope of the invention should be determined by the appended claims and their legal equivalents, rather than strictly by the examples given.

The invention claimed is:

1. A rigid hand weight comprising:

a rigid, substantially flat handle portion sized and shaped such that two or more handles from other units may fit in the user's hand at the same time further comprising:

a rigid weighted portion disposed on either end of each handle portion, the rigid weighted portion having substantially the same thickness as the handle portion and extending in the same plane as the handle portion and further shaped to stack with two or more similar weighted portions of other units when their respective handles are brought together in the user's hand further comprising:

a rigid segmented hand weight that is held together by the user's grip when the handle portions are clustered together within the user's hand.

* * * * *